US006276967B1

(12) United States Patent
Hall

(10) Patent No.: US 6,276,967 B1
(45) **Date of Patent: *Aug. 21, 2001**

(54) SHIELD TERMINATION CONNECTOR ASSEMBLY AND METHOD FOR USING THE SAME

(75) Inventor: Allen L. Hall, Wichita, KS (US)

(73) Assignee: Raytheon Aircraft Corporation, Lexington, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/992,807

(22) Filed: Dec. 18, 1997

(51) Int. Cl.[7] ..... H01R 9/03
(52) U.S. Cl. ..... 439/610
(58) Field of Search ..... 439/610, 98, 579, 439/607, 312

(56) References Cited

U.S. PATENT DOCUMENTS

| | | | | |
|---|---|---|---|---|
| 3,926,499 | * | 12/1975 | Bailey et al. | 439/610 |
| 3,944,317 | * | 3/1976 | Oberdiear | 439/610 |
| 3,990,765 | * | 11/1976 | Hill . | |
| 5,052,947 | * | 10/1991 | Brodie et al. | 439/607 |
| 5,246,376 | * | 9/1993 | Schuhl et al. | 439/610 |
| 5,366,383 | * | 11/1994 | Dearman | 439/321 |

FOREIGN PATENT DOCUMENTS

| | | | |
|---|---|---|---|
| 39 13 544 | * | 4/1989 | (DE) . |
| 0 546 657 | * | 5/1992 | (EP) . |
| 0 724 310 | * | 1/1996 | (EP) . |

OTHER PUBLICATIONS

Correspondence from Joel T. Barbieri with ICORE International, Inc. dated Oct. 31, 1997.*

Brochure entitled: "OPTILOCK The Antivibration Solution" from ICORE International, Inc. no date avail.*

International Search Report dated Apr. 9, 1999 (PCT/US98/26371)(RAYT:008).*

* cited by examiner

*Primary Examiner*—Gary Pauman
*Assistant Examiner*—Antoine Ngandjui
(74) *Attorney, Agent, or Firm*—Fulbright & Jaworski, LLP

(57) ABSTRACT

Shielding of electrical wires from radiated energy and lightning is critical to protecting the integrity of electronic components. A shield termination electrical connector assembly uses a termination adapter having elongated termination holes and feed channels leading into the termination holes to facilitate the process of guiding the shields into the proper termination slots. Moreover, flexible braided wires may be connected to the shields and terminated in the termination adapter. These flexible braided wires are compressed in the termination adapter instead of the shields, thus preventing damage to the shields to ensure their functionality.

13 Claims, 4 Drawing Sheets

SHIELD TERMINATION CONNECTOR ASSEMBLY AND METHOD FOR USING THE SAME

FIELD OF THE INVENTION

The present invention relates generally to a connector assembly, and more particularly to an interlocking shield termination connector assembly that provides for easy grounding of shields.

BACKGROUND OF THE INVENTION

Current technology has brought about the proliferation in use of electronics and electronic equipment. It becomes increasingly important to protect sensitive electronic equipment from the effects of electromagnetic interference (EMI), high intensity radiated field (HIRF), and lightning to prevent potential failures or a system upset. One way to protect the equipment is to shield the wires that are connected to the equipment by adding a shield over the length of sensitive signal and/or power wires. The shield is usually constructed from several small gauge wires braided over the internal signal and/or power wires or conductors. The shield absorbs radiated energy and distributes the energy away from the internal conductors and their connected electronic component. The wires forming the shields are typically grounded at every connector interface throughout the electrical system. Proper grounding of each shield is an important aspect of protecting sensitive electronic equipment.

Most products on the market today use a backshell assembly with a compression ring to ground shields, but they are very difficult and time-consuming to assemble and disassemble. For example, with currently available backshell assemblies, the shields must be manually separated from their respective internal conductors and then threaded through small isolated termination holes in the compression ring to terminate the shields. A person uses either a crochet-like hook or a pick to pull the shields through the holes. This process has the disadvantages of being difficult, tedious and slow, because it is akin to threading a needle, only with much coarser filaments and little room for maneuverability. Moreover, when there are a large number of shields in the wire harness, the task becomes nearly impossible due to the spacing constraints. The internal conductors, from which the shields have been separated, are connected to connector pins for making the next level of electrical connection in the system.

Once the shields are terminated in the termination holes, the backshell is screwed tightly onto the mating connector to compress the shields between the compression ring and the backshell to obtain a good electrical connection between the shields and the backshell. During this process small fragments of the shield, from the braided small gauge wires, can fray, break and fall into the connector which can then cause electrical shorting of the connector pins. Another problem encountered in the prior art is that shields tend to become crushed after undergoing repeated vibrations and thermal cycling, and loss of electrical contact can occur. Once this happens, the functionality of the shield is lost, and the attendant electronic component would no longer be shielded from radiated energy.

Hence, a need exists for a shield termination connector assembly that is simple to assemble and use, that does not damage portions of the shields during assembly, and that does not require special hand tools for feeding the shields into termination holes.

SUMMARY OF THE INVENTION

The present invention is particularly useful where shielding of electrical wires from radiated energy, such as EMI and HIRF as well as lightning, is critical to protecting the integrity of electronic components. The invention provides, as part of the shield termination electrical connector assembly, an easy to use termination adapter having elongated termination holes and feed channels leading into the termination holes for simple termination of the shields. Moreover, the invention also provides a method for using the connector assembly that mitigates damage of the shields during assembly as well as test and actual operation, thus preventing electrical shorting problems.

These and other features and advantages will be more clearly understood from the following detailed description taken in conjunction with the accompanying drawings. It is important to point out that the illustrations may not necessarily be drawn to scale, and that there may be other embodiments of the present invention which are not specifically illustrated. Furthermore, as many of the figures illustrate the same or substantially similar elements, like reference numerals will be used to designate elements that are the same or substantially similar in shape or function.

DESCRIPTION OF ILLUSTRATIVE EMBODIMENTS

The following detailed description discusses preferred embodiments of the invention. It should be appreciated by those skilled in the art that these embodiments represent techniques discovered by the inventor to function well in the practice of the invention, and thus can be considered to constitute preferred modes for its practice. However, those skilled in the art should, in light of the present disclosure, appreciate that many changes can be made in the specific embodiments which are disclosed and still obtain a like or similar result without departing from the spirit and scope of the invention.

Figure 1:
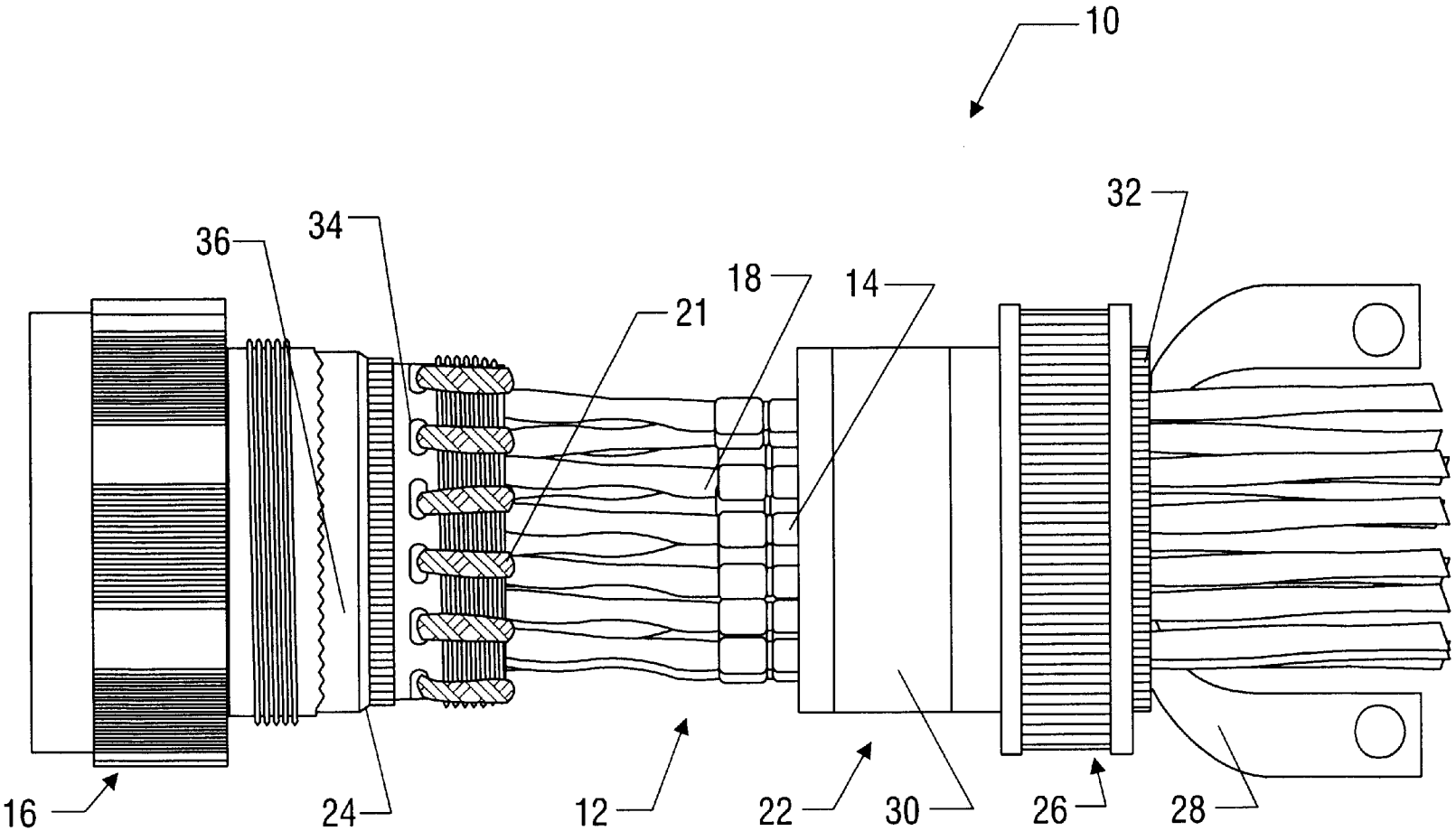
FIG. 1 illustrates, in a side view, a shield termination electrical connector assembly in accordance with an embodiment of the present invention.

FIG. 1 illustrates, in a side view, a partially assembled shield termination electrical connector assembly 10 in accordance with the invention. The partially assembled assembly 10 includes a shield termination electrical connector assembly 12, wire harness 14, and an external connector 16. Wire harness 14 comprises a bundle of wires 18, where wires 18 extend from an external electronic component (not shown) and are connected or pinned to connector 16, such that the connector 16 may then be connected to another electronic component (not shown). Wire harness 14 may contain as many as 125 wires in the bundle although the actual number of wires present would depend on the specific application. Each wire 18 is composed of at least one insulated internal conductor 19 (illustrated in FIG. 2) and a shield 21. A typical wire used for connecting electronic components is a twisted shield pair, which has two insulated internal conductors twisted about one another and a shield woven around the length of the internal conductors. The shields may be composed of tin, nickel, silver, or another conductive material although they are not limited to these materials. The function of the shield is to absorb radiated energy and to distribute the energy to an electrical ground.

The shield termination assembly 12 has a backshell 22, a termination adapter 24, and a locking ring 26. The termination adapter 24 is designed to fit inside the backshell 22 between the backshell 22 and the connector 16. The locking ring 26 fits outside the backshell 22 and is displaceable axially between two positions—locked and unlocked—along the backshell 22. Backshell 22 has a first component 28 fitted to a second component 30, wherein these two components are rotatable with respect to each other when they are not locked by locking ring 26. The first component 28 may be a conventional coupling nut, while the second component 30 may be a hollow cylinder to allow the bundle of wires 18 to pass through. Both components of the backshell 22 have outer surface formations 32 that are designed to cooperate with a surface formation on the inside of the locking ring 26. These surface formations are generally composed of a series of ridges or teeth. The locking ring 26 is designed to prevent rotational movement between the first and second components 28 & 30 by engaging the surface formations 32 on both components when the locking ring 26 is in the locked position. Conversely, the locking ring 26 is in the unlocked position when its inner surface formation is out of engagement with one of the surface formations 32 on the backshell 22.

Figure 8:
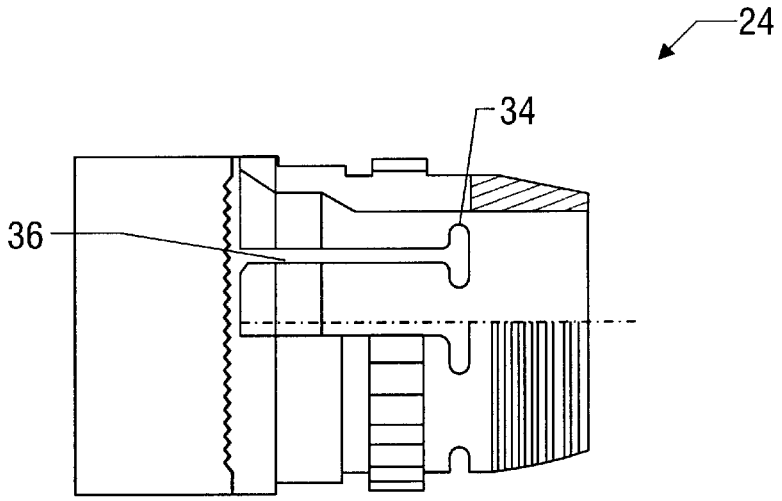
FIG. 8 illustrates, in a side view, a termination adapter having an elongated termination hole and a feed channel, in one embodiment of the present invention.
Figure 9:
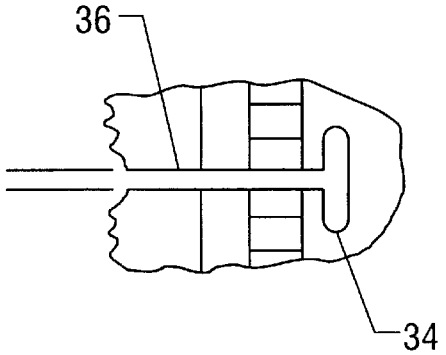
FIG. 9 illustrates a close-up detail of the exemplary termination hole illustrated in FIG. 8.

The termination adapter 24 is composed of a conductive material and is used to terminate the shield wires 21 coming from the wire harness 14. Adapter 24 has multiple elongated termination holes 34 with a feed channel 36 connected to each termination hole 34. These features are shown in more detail in FIGS. 8 & 9, which illustrate an exemplary embodiment of the termination adapter 24 of the present invention.

Because the feed channels 36 extend from one end of the termination adapter 24 to connect to the termination holes 34, the shield wires 21 can simply be pulled from the end of the termination adapter 24 through the feed channels 36 into the holes 34. The termination holes 34 are elongated, meaning that they are longer in one dimension than in another dimension, so that the shields 21 can easily be arranged in the hole 34. Furthermore, the feed channel 36 should be at least as wide as the thickness of the shield to be functional, although some clearance is preferred so that the shields do not become damaged during assembly and disassembly. No specific number of feed channels per termination adapter is required, especially since the adapter can vary in size, but the physical integrity of the termination adapter needs to be preserved so the number of feed channels should be minimized. There is a one to one correspondence between the number of feed channels and termination holes. It should be understood that each termination hole is intended to be capable of housing more than one shield since a wire harness will typically contain more shields than there are termination holes in the termination adapter. The termination adapter 24 has multiple advantages over the prior art because it allows for easy feeding and guiding of the shield wires into the elongated termination holes 34 without needing to use special hand tools, such as a crochet-like hook or a pick.

The shield termination assembly 12 can easily be manufactured to conform to relevant standards, including U.S. MIL standards and European standard equivalents. In fact, the size of the shield termination assembly 12 will be dictated by the size of the external connector 16. In the assembled form, the termination adapter 24 fits inside the backshell 22 and the shield wires 21 are compressed against an inner surface of the backshell 22. The compression helps to maintain a solid contact between the shields and the backshell which grounds the shields since the backshell, the connector and the termination adapter are made of conductive materials and are terminated to an electrical ground. The backshell 22 and the connector 16 have mating engageable screw threads so that they can simply be connected via relative rotational movement.

Figure 2:
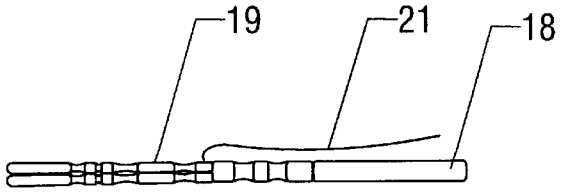
FIGS. 2–7 illustrate steps of using the shield termination electrical connector assembly of FIG. 1, in accordance with the present invention.

FIGS. 2–7 illustrate method steps for using the shield termination electrical connector assembly in accordance with the present invention. In FIG. 2, a wire 18 from a wire harness is stripped of a portion of its outer insulative covering to expose a portion of the internal conductor 19 and shield 21. The exposed portion of the shield 21 is then separated from the exposed portion of the internal conductor 19. The exposed portion of shield 21 should be sufficiently long so that the shield can be terminated in the termination adapter. In a preferred method, after the wire 18 is stripped of its outer insulative covering to expose a portion of the internal conductor 19 and the shield 21, the shield 21 is then trimmed to allow the attachment of a second wire to the shield. This second wire is preferably braided and is terminated in the termination adapter.

There are two engineering criteria for properly grounding the shields. First, the length of the exposed shield portion 21 that is separated from the exposed internal conductor portion 19 should be as short as possible to minimize the impedance of the shield termination. A length of 3 inches (7.6 cm) or less is preferred. Second, the length of the exposed internal conductor portion should also be minimal, preferably less than 3 inches (7.6 cm), to minimize coupling of radiated energy onto the internal conductor. For most applications, stripping away 1 to 2 inches (2.5 cm to 5 cm) of insulation is adequate. The length of the exposed internal conductor portion 19 needs to be only long enough to allow pinning it to the appropriate external connector. The exposed shield portion 21 may be trimmed back to as little as 0.2 inches (0.5 cm), although it may be left longer or shorter if a specific length is required for proper termination.

One of the problems encountered in the prior art is that that the shield 21 has a tendency to fray and break in the compression ring during assembly, test and operation due to the brittle nature of the shield wire. An improvement offered by a method of the present invention involves attaching a flexible braided wire 40 to the end of the exposed shield portion 21 so that the shield portion itself is not compressed once the assembly is completed. The braided wires, typically composed of tin plated copper or solder plated copper, are more ductile than the shields and can withstand more stress without becoming frayed or breaking. Commercially available solder sleeves having these flexible braided wires 40 attached at one end are easily obtained. These solder sleeves are heat-shrinkable and simple to use. The exposed shield portion 21 is inserted inside the solder sleeve, heat is then applied to shrink the sleeve and to reflow the solder, thus making the connection between the flexible braided wire 40 and the shield portion 21.

Figure 3:
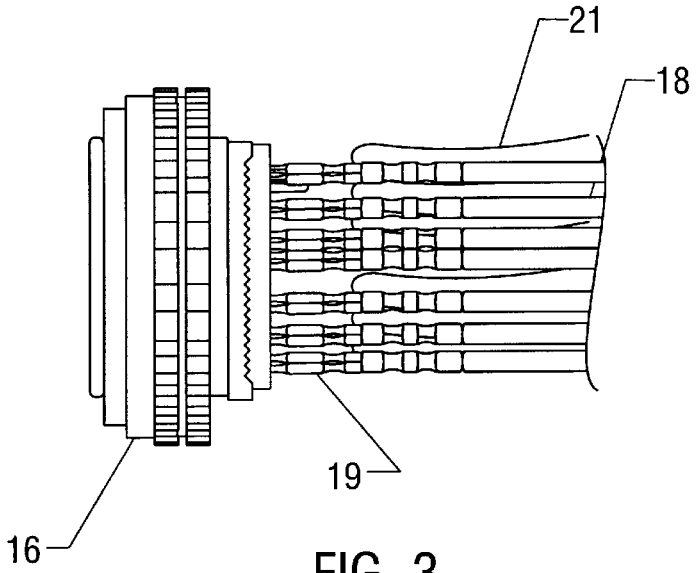

In FIG. 3, the exposed internal conductor portions 19 are connected to the external connector 16. The process of connecting these conductor portions 19 varies with each end user. However, a typical process would involve attaching pins to the ends of the conductors and then inserting the pins into the appropriate holes in a grommet (not illustrated) housed inside the connector 16.

Figure 4:
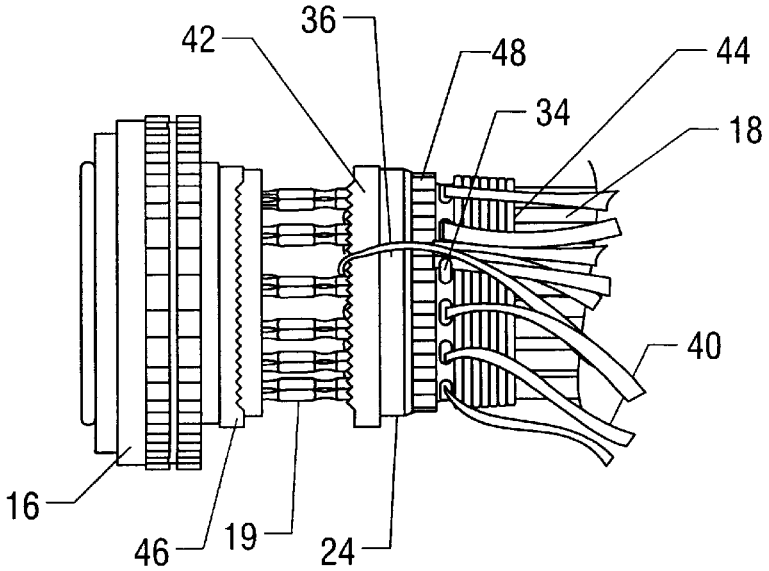
Figure 5:
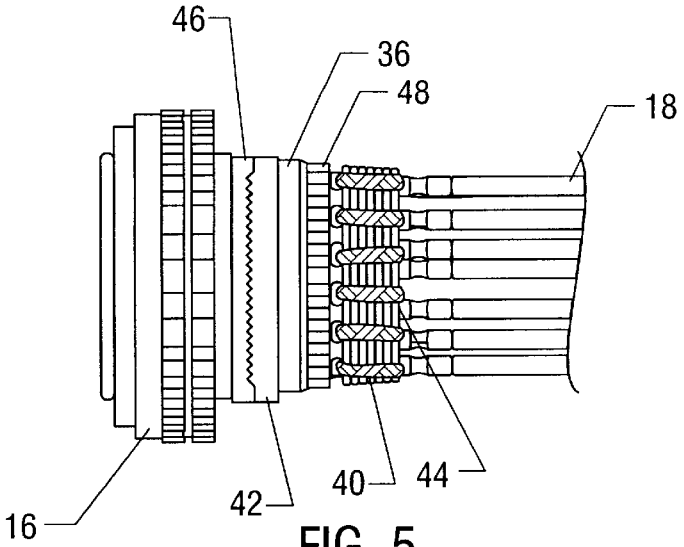

FIG. 4 illustrates the flexible braided wires 40 being guided through the feed channels 36 in the termination adapter 24 into the elongated termination holes 34. Since the feed channels 36 extend from edge 42 of the termination adapter 24, the braided wire 40 can simply be pulled into the termination hole 34 without the need for special hand tools. It is desirable that the braided wires 40 be evenly spaced around the termination adapter 24; that is, no one termination hole 34 should house a disproportionate number of braided wires 40 as compared to another termination hole 34. This even spacing facilitates the closure of the backshell 22 over the termination adapter 24 and ensures that each braided wire 40 is properly terminated and grounded. The braided wires 40 are then pulled toward edge 44 of the termination adapter 24, away from the connector 16. The braided wires 40 may be tucked back inside the termination adapter 24 so that the ends of the braided wires 40 are concealed and protected, as illustrated in FIG. 5.

Figure 6:
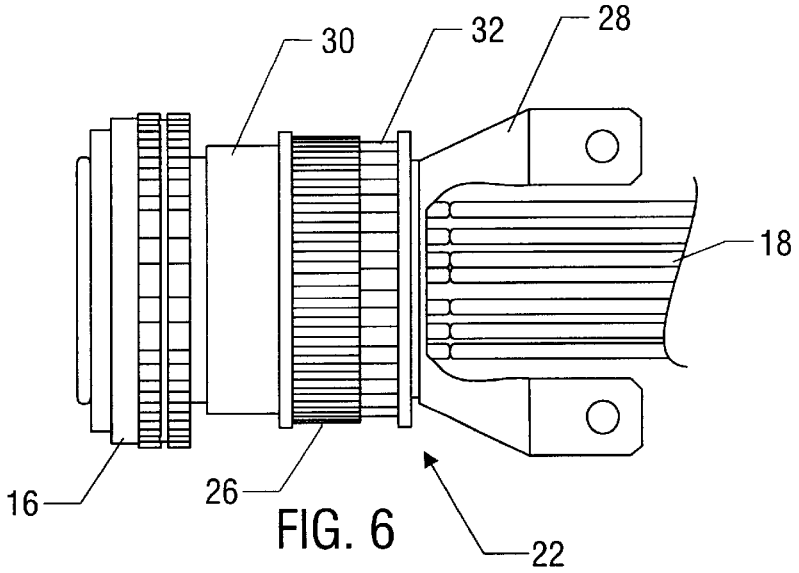
Figure 7:
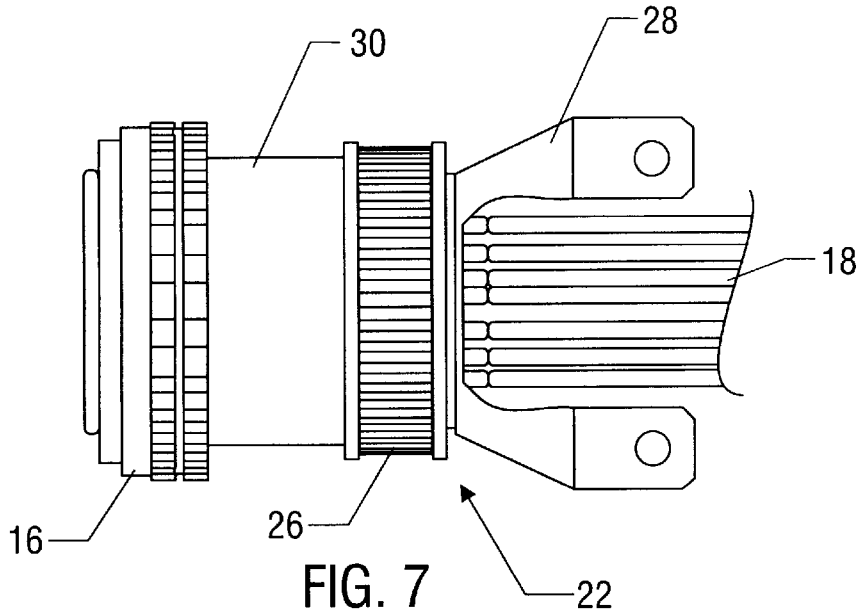

Once the braided wires 40 are properly terminated in the elongated termination holes 34, the backshell 22 is brought forward to engage both the termination adapter 24 and the connector 16, as illustrated in FIG. 6. Edge 42 of the termination adapter 24 is adapted to fit the mating edge 46 of the connector 16. Additionally, the termination adapter 24 has a series of ridges or teeth around its circumference that is designed to engage a cooperating series of ridges or teeth inside the backshell 22. Once the mating ridges engage, rotational movement between the termination adapter 24 and the backshell 22 is prevented. The backshell 22 and the connector 16 are screwed together via their mating screw threads. The braided wires 40 that were terminated in the termination holes 34 in the adapter 24 are compressed against an inner surface of the backshell 22. It is important that a sufficient torque is applied to either the backshell 22 and/or the connector 16 so that the two components are tightly interlocked to ensure a good electrical connection for the braided wires 40, hence the shields. Moreover, a proper torque ensures that vibrations and thermal cycling affecting the assembly do not cause of loss of electrical contact for the shields. As mentioned previously, the locking ring 26 is pulled into the locking position to prevent further relative rotational movement between the different components. And because all the components are fully engaged and interlocked through the various surface formations, further translational movement is also prevented.

Thus, it is apparent that there has been provided, in accordance with the invention, a shield termination electrical connector assembly and a method for using the same that fully meet the needs and advantages set forth previously. All of the embodiments of the shield termination device disclosed and claimed herein can be made and executed without undue experimentation in light of the present disclosure. Furthermore, although the invention has been described and illustrated with reference to specific embodiments thereof, it is not intended that the invention be limited to these illustrative embodiments, because it is apparent to those skilled in the art that variations may be applied to the device and/or method and in the steps or in the sequence of steps of the method described herein without departing from the concept, spirit and scope of the invention. Although the invention was originally conceived for use in the aircraft industry, its use is not limited to aircraft electronic components. Rather, any industry where grounding of wires through a connector assembly is routinely done can benefit from application of the present invention. Additionally, although the detailed description discusses using different materials for the shield wire and for the braided wire, one could use the same metal or metal alloy for both. Therefore, all such similar substitutes and modifications apparent to those of ordinary skill in the art are deemed to be within the spirit, scope and concept of the invention as defined by the appended claims.

What is claimed is:

1. A shield termination electrical connector assembly, comprising:

a termination adapter having a plurality of elongated termination holes disposed around a perimeter of the termination adapter for terminating a plurality of shield conductors, and a plurality of feed channels extending from a first end of the termination adapter to the plurality of elongated termination holes for guiding the plurality of shield conductors into the plurality of elongated termination holes;

a shell assembly having a first component and a second component, wherein the first and second components are coupled and are rotatable relative to each other, and wherein the termination adapter is fittable into the second component and cooperable with the first component; and a locking component that is engageable with the shell assembly to lock the termination adapter in place in the shell assembly.

2. The shield termination electrical connector assembly of claim 1, wherein the first component and the termination adapter have cooperating pluralities of ridges that allow the first component and the termination adapter to interlock.

3. The shield termination electrical connector assembly of claim 1, wherein the first and second components and the termination adapter are electrically conductive.

4. The shield termination electrical connector assembly of claim 1, further comprising:

a shield conductor soldered to a braided wire, wherein the braided wire is disposed in one of the plurality of elongated termination holes and wherein the braided wire is compressed between the termination adapter and the first component.

5. The shield termination electrical connector assembly of claim 1, wherein the second component of the shell assembly has a plurality of screw threads on an inner surface of the second component for engaging a mating plurality of screw threads on a mating connector.

6. A method for using a shield termination electrical connector assembly, comprising the steps of:

providing an insulated wire having a stripped portion which has an internal conductor portion and a shield conductor portion, wherein the internal conductor portion is longer than the shield conductor portion;

physically and electrically connecting the shield conductor portion to a braided wire;

providing a termination adapter having a plurality of elongated termination holes disposed around a perimeter of the termination adapter and a plurality of feed channels extending from a first end of the termination adapter to the plurality of elongated termination holes;

guiding the braided wire through one of the plurality of feed channels into one of the plurality of elongated termination holes;

connecting a backshell component and a connector together with the termination adapter disposed there between such that the braided wire is compressed between a second end of the termination adapter and the backshell component; and locking the backshell component using a locking component that is axially displaceable along the backshell component and that, in a locked position, engages a surface formation on the backshell component, to prevent rotational and translational movement between the backshell component and the termination adapter.

7. The method of claim 6, wherein the step of physically and electrically connecting the shield conductor portion is performed by using a heat-shrinkable solder tube to connect the shield conductor portion to the braided wire.

8. The method of claim 6, wherein the step of connecting the backshell component to the connector comprises the steps of:

engaging a first plurality of screw threads on the backshell component with a second plurality of screw threads on the connector; and rotating the backshell component and the connector with respect to each other until the backshell component and the connector are sufficiently tightly connected.

9. The method of claim 6, wherein the step of providing the termination adapter provides an adapter having a first plurality of ridges around a perimeter of the adapter, wherein the first plurality of ridges is shaped to cooperate with a second plurality of ridges located on an inner surface of the backshell component to prevent rotational movement between the termination adapter and the backshell component.

10. A method for using a shield termination electrical connector assembly, comprising the steps of:

providing an insulated harness wire having a portion of its insulation stripped to expose a shield portion and an internal conductor portion, wherein the shield portion is shorter than the internal conductor portion;

soldering the shield portion to a flexible braided wire;

connecting the internal conductor portion to a connector;

guiding the flexible braided wire through a feed channel in a termination adapter into an elongated termination hole in the termination adapter, wherein the feed channel extends from a first end of the termination adapter to the elongated termination hole and wherein the first end of the termination adapter is adjacent to and engageable with the connector;

terminating the flexible braided wire over a second end of the adapter;

placing a backshell component over the second end of the adapter;

rotating the backshell component and the connector with respect to each other to compress the flexible braided wire against the backshell component; and locking the backshell component to the connector by sliding a locking component from an unlocked position to a locked position, wherein the locking component has an internal surface formation that engages with an outer surface formation on the backshell component in the locked position to prevent rotational movement of the backshell.

11. The method of claim 10, wherein the step of soldering the shield portion comprises heating a heat-shrinkable solder sleeve around the shield portion to reflow solder in the solder sleeve to connect the shield portion to the flexible braided wire.

12. The method of claim 10, further comprising the step of tucking a free end of the flexible braided wire inside the termination adapter.

13. The method of claim 10, wherein the step of providing the insulated harness wire provides a shielded wire having at least one internal conductor and a shield woven around a length of the at least one internal conductor.

* * * * *